United States Patent [19]

Mennell

[11] Patent Number: 4,633,047

[45] Date of Patent: Dec. 30, 1986

[54] ISOLATOR SWITCH WITH INTERLOCK

[75] Inventor: Thomas W. Mennell, Scarborough, England

[73] Assignee: Y. S. Securities Limited, Leeds, England

[21] Appl. No.: 684,014

[22] Filed: Dec. 20, 1984

[30] Foreign Application Priority Data

Dec. 24, 1983 [GB] United Kingdom ..... 8334481

[51] Int. Cl.[4] ..... H01H 9/20

[52] U.S. Cl. ..... 200/50 R; 200/50 A

[58] Field of Search ..... 200/42 R, 48 KB, 50 R, 200/50 A, 50 C, 252, 256, 259, 49, 254, 255, 257, 260, 261, 43.01, 43.04, 43.07, 43.08, 321, 322; 361/343

[56] References Cited

U.S. PATENT DOCUMENTS

| | | | |
|---|---|---|---|
| Re. 28,243 | 11/1974 | Rys | 200/256 |
| 1,018,501 | 2/1912 | Jordan | 200/43.07 |
| 1,540,795 | 6/1925 | Monson | 200/50 A |
| 2,660,648 | 11/1953 | Luebkert | 200/260 |
| 3,183,335 | 5/1965 | Cobbett | 200/256 X |
| 3,244,827 | 4/1966 | Kussmaul | 200/50 A |
| 3,519,970 | 7/1970 | Lusk et al. | 200/50 A X |

FOREIGN PATENT DOCUMENTS

| | | |
|---|---|---|
| 514697 | 11/1939 | United Kingdom . |
| 902739 | 8/1962 | United Kingdom . |
| 1059545 | 2/1967 | United Kingdom . |
| 1183525 | 3/1970 | United Kingdom . |
| 1227158 | 4/1971 | United Kingdom . |

*Primary Examiner*—J. R. Scott

*Attorney, Agent, or Firm*—Henry Sternberg; Bert J. Lewen

[57] ABSTRACT

An electrical isolator has an insulated housing with input and output conductors (1, 2) therein. A spring contact (6) is mounted within the housing for movement between open and closed positions. An insulating shroud (15) fully shields that part of the bridging contact accessible through an access opening of the housing. Manually operable pressure applying structure may be operated when the bridging contact is in the closed position to control that contact between a tightened condition applying pressure between the bridging contact and the conductors without the use of springs, and a free condition wherein the contact pressure is reduced. An interlock assembly prevents engagement and disengagement of the operating member with the pressure applying structure unless the bridging contact is located in either the closed or open position.

13 Claims, 6 Drawing Figures

ISOLATOR SWITCH WITH INTERLOCK

BACKGROUND OF THE INVENTION

This invention relates to electrical isolators.

In the particular context of feeder pillars used in electrical distribution networks the isolators used in said pillars present a significant quantity of exposed bare metal, which is a potential hazard. Such isolators comprise a bridging contact capable of being tightened into engagement with the input and output conductors through the use of suitable tightening devices designed to apply pressure to the bridging contact to hold it in firm electrical engagement with the input and output conductors. In view of the exposed bare metal it is current practice for the tightening devices to be tightened and loosened by means of a long insulated pole, the contact being hinged out of its bridging position when the devices are loosened.

Equivalent isolators used on the continent of Europe are provided with better insulation than those in the United Kingdom and are thus safer from an operator's point of view. However, the continental isolators rely on springs to apply the required contact pressure between the bridging contact and the input and output conductors. Springs relax with aging, and there is thus the potential danger of the contact pressure being reduced to a limit below that required for proper safety of operation.

The object of the present invention is to provide an isolator that does not suffer this disadvantage, and that is capable of being insulated to a high standard of safety and also of being provided with additional safety interlocks.

SUMMARY OF THE INVENTION

According to the invention an electrical isolator comprises an insulated housing having an access opening therein, an input conductor and an output conductor mounted at spaced-apart locations within the housing, a bridging contact, means mounting the bridging contact within the housing for movement between an open position out of engagement with at least one of the conductors and a closed position in engagement with both conductors, an insulating shroud fully shielding that part of the bridging contact accessible through the access opening of the housing, and manually operable pressure-applying means associated with the bridging contact and such that the pressure-applying means may be operated when the bridging contact is in the closed position to control the bridging contact between a tightened condition wherein contact pressure is applied between the bridging contact and the conductors without the use of springs and a free condition wherein the contact pressure is reduced.

By avoiding the use of springs in the application of contact pressure that pressure may be set to a predetermined value which will remain substantially constant during the life of the apparatus. This is achieved within a fully insulated structure that will protect an operator against accidental contact with live metal.

Preferably the pressure-applying means has a part engageable by an operating member, and the engageable part is insulated. Desirably the engageable part of the pressure-applying means is accessible by a manually held tool inserted through an opening in the insulating shroud.

Conveniently the pressure-applying means comprises a cam arrangement. The bridging contact may then comprise opposed links, one lying to each of two opposite sides of the conductor, and the cam arrangement is such as to move the links from the free condition towards each other into the tightened condition. By appropriate use of cam means positively moved into either of two limit positions, one corresponding to the tightened condition and one to the free condition of the bridging contact it will readily be seen that a predetermined and constant pressure may be applied to the bridging contact in each tightening operation. Other means of applying the tightening action, for example suitable lever arrangements, could alternatively be used, but a cam system presents particular advantage in ease of operation and in compactness of design.

Preferably the isolator includes interlock means effective to perform any one or more of the following functions:

(a) ensure that the bridging contact cannot move from the closed to the open position unless it is in the free condition;

(b) ensure that the bridging contact cannot move from the open to the closed position unless it is in its free condition;

(c) ensure that the bridging contact cannot be operated between its free and tightened conditions unless it is in either the closed or open position;

(d) ensure that any operating member cannot be operatively engaged and disengaged with the pressure-applying means except when the bridging contact is in either the open or the closed position.

In embodiments of the invention wherein the pressure applying means includes a cam arrangement then that arrangement preferably comprises a rotary cam and a drive shaft therefor, the shaft carrying an interlock member co-operable with an interlock member on the insulated housing to prevent movement of the bridging contact between its open and closed positions unless the angular orientation of the shaft corresponds to the free condition of the bridging contact.

Inadvertent opening or closing of the bridging contact without first effecting the required rotation of the shaft is thus prevented. Conveniently, when the shaft is designed for rotation by a manually held operating tool then there is a further interlock between that tool, the shaft and the housing to ensure that the tool can only be engaged with and disengaged from the shaft when the shaft is in the angular orientation corresponding to the tightened condition of the bridging contacts.

BRIEF DESCRIPTION OF THE DRAWINGS

In order that the invention may be better understood a particular embodiment of isolator in accordance therewith will now be described in more detail, by way of example only, with reference to the accompanying drawings in which.

DESCRIPTION OF THE PREFERRED EMBODIMENTS

Figure 1:
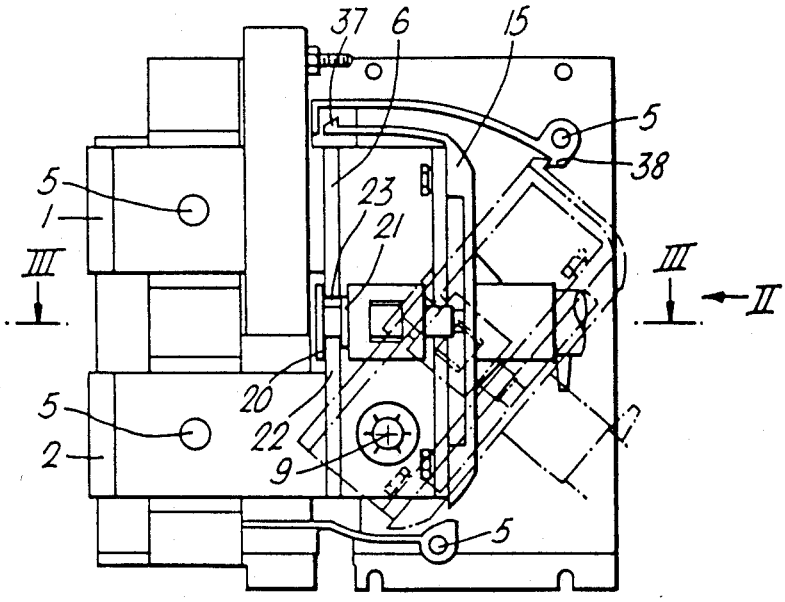
FIG. 1 is a plan view of the isolator with an external casing removed.
Figure 2:
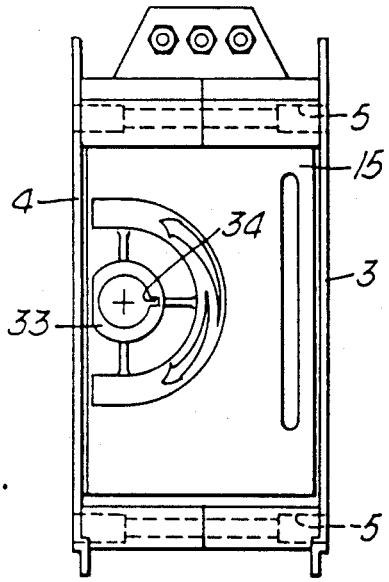
FIG. 2 is an elevation on the arrow II of FIG. 1.

The drawings show a single pole isolator unit that may be included in a feeder pillar of an electrical distribution network. The general design of such pillars is well known to those skilled in the art. The isolator comprises an input and output conductor 1 and 2 respectively, located within a housing comprising two insulating members 3, 4 secured together by nut and bolt arrangements 5. The two conductors are insulated one from the other within the housing and they may be bridged by a bridging contact shown generally as 6. The bridging contact comprises a pair of links 7 and 8 which are pivoted together on the output conductor 2 for movement about a pivot axis 9. The links are joined by a bolt 10 lying between the input and output conductors. The links have flat faces 11 and 12 respectively capable of engaging and making contact with flat faces 13 and 14 of the output conductor 2 and with corresponding flat faces on the inlet conductor 1.

The bridging contact also includes an insulating housing section 15 which fits closely between the housing sections 3 and 4 and shields the whole of the links 7 and 8 and the ends of the input and output conductors against accidental contact from the front 16 of the housing.

In order to ensure adequate contact pressure between the bridging contact and the input and output conductors means are provided for tightening the links 7 and 8 against those conductors.

Figure 6:
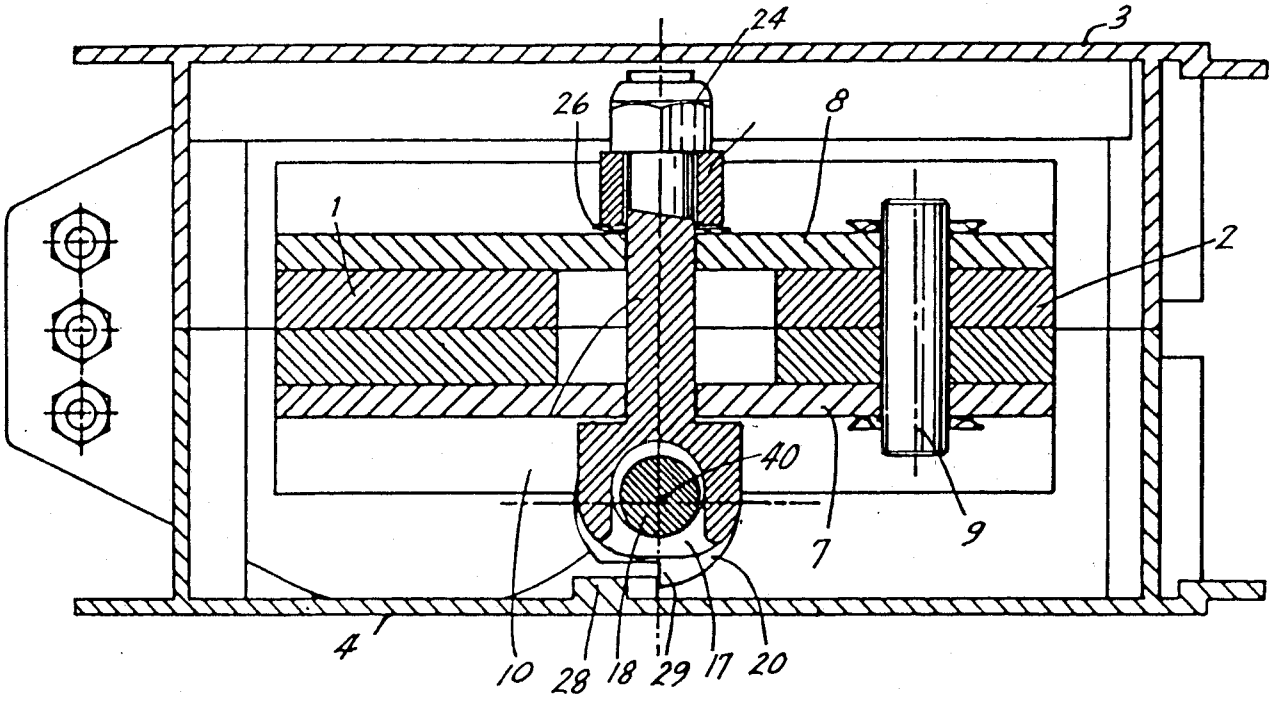
FIG. 6 is a cross-section taken on the line VI—VI of FIG. 5.

One end of the bolt 10 is provided with two spaced eyes 17 through which passes an eccentric section 18 of an operating shaft 19. The shaft is rotatably mounted within the housing relative to the links 7 and 8 and is axially captive relative to the links by virtue of an end plate 20 and annulus 21 engaging two opposite sides of a part 22 of the link 7. Between the end plate 20 and the annulus 21 the shaft is provided with a rib 23 engageable with the part 22 to limit rotation of the shaft through substantially 180° about the axis 40 (FIG. 6) from the position shown in FIGS. 1 and 3.

The opposite end of the bolt 10 carries a nut 24 and between that nut and the link 8 there are a sleeve 25 and a wavy spring washer 26.

Figure 3:
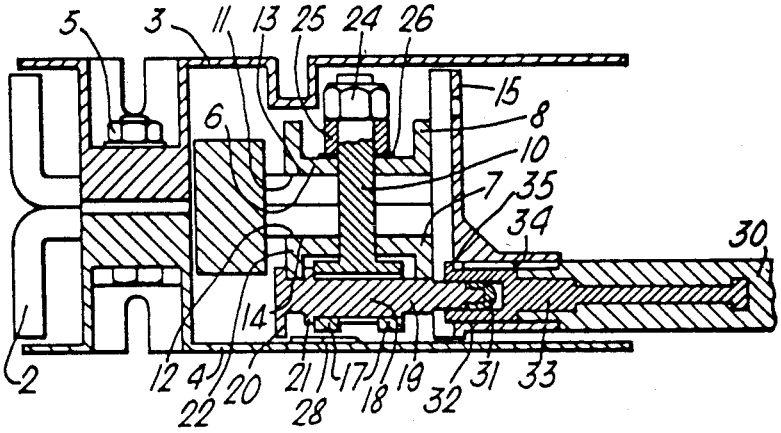
FIG. 3 is a cross-section taken on the line III—III of FIG. 1 showing the bridging contact in closed, i.e. tightened position.
Figure 4:
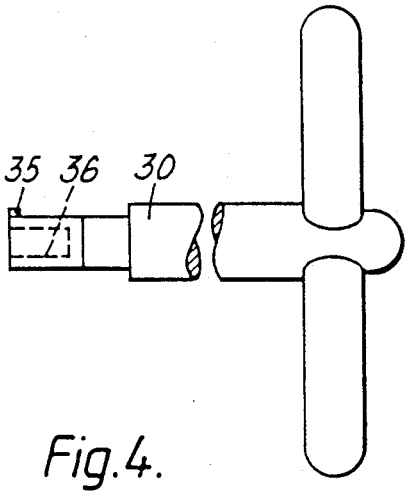
FIG. 4 shows an operating handle for use with the isolator.
Figure 5:
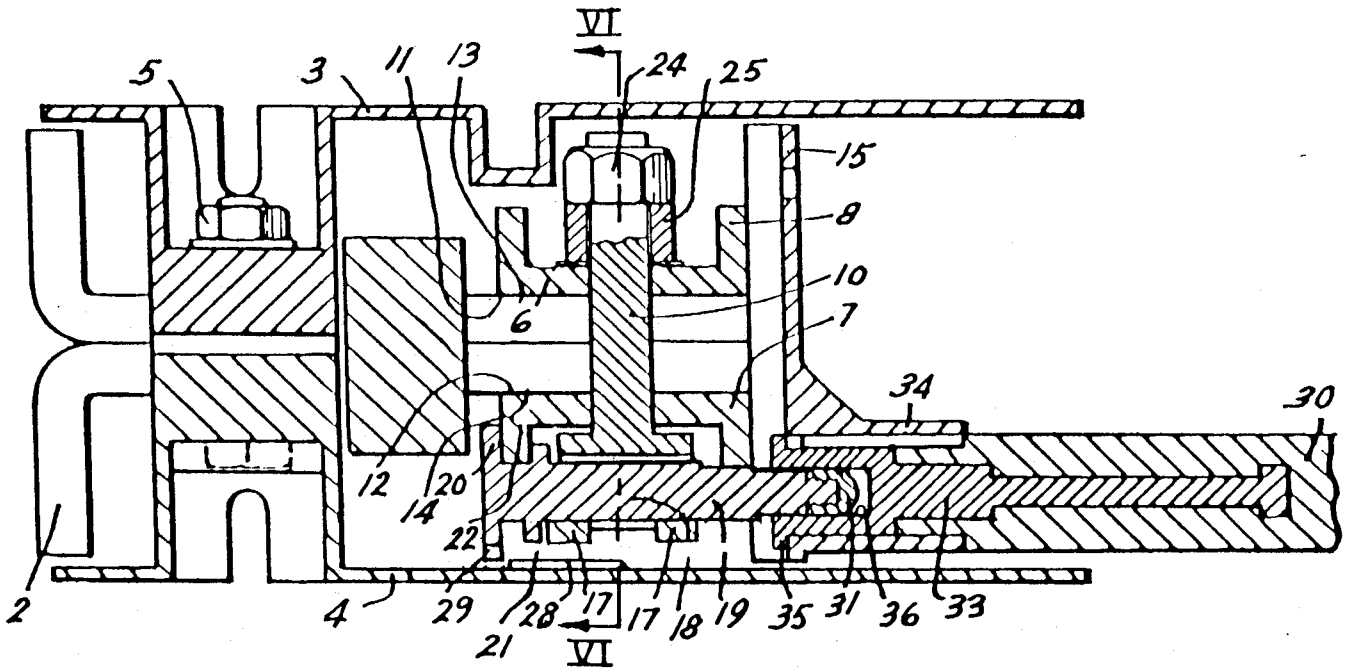
FIG. 5 is a cross-section taken on the line III—III of FIG. 1 but showing the parts with the contact pressure relaxed.

The plate 20 on the inner end of the shaft 19 is in the form of a circular disc with part cut from its circumference along a radius and a line at right angles thereto, so leaving a nose section. In the position shown in FIG. 3 the nose section of the plate lies in a location adjacent to a raised portion 28 on the inner surface of the housing section 4. Movement of the shaft past the raised portion 28 is thus prevented. However, by rotating the shaft through substantially 180° the cut away part of the plate 20 is brought into alignment with the raised portion 28 and the shaft is then free to move past the raised portion. It will be understood that this rotation of the shaft will have produced a camming action due to the engagement of the eccentric section 18 of the shaft within the eye pieces 17 and will thus have caused movement of the bolt 10 upwardly as seen in FIG. 3 so relaxing the pressure that held the links 7 and 8 in firm engagement with the input and output conductors.

Rotation of the shaft 19 between its two positions is effected by a hand-held operating member 30 formed of insulating material. The outer end of the shaft 19 is of square section and is fitted with an insulated tip 31 lying within an insulated sheath 32 projecting from the housing 15. The sheath is formed with a key way 34. The operating member has a metal core 33, the end of which is formed with a corresponding key 35, and is also formed with a square section opening 36 which may engage over the end 31 of the shaft 19. It will be seen that the operating member may only be moved into engagement with and disengagement from the shaft 19 when the key 35 is properly aligned with the key way 34.

The isolator is shown with the bridging contacts in their closed position and in the condition where they are tightened into firm engagement with the input and output conductors. As seen from FIG. 3 the cam arrangement formed by the eccentric section 18 of the shaft and the eyes 17 on the bolt 10 have cooperated to pull the bolt downwardly so applying a firm and constant pressure to the links to hold them against the conductors. In this condition the wavy spring washer 26 is flattened and exerts no spring effect. There is thus no element of this system that can relax with age and the contact pressure once applied will be maintained indefinitely at a constant level until it is released.

In order to break the circuit the contact pressure must first be released so moving the bridging contact to its free condition and the bridging contact must then be moved to the open position as shown in broken lines in FIG. 1. This operation is effected using the operating member 30. In the tightened condition of the bridging contact, as limited by the engagement of the rib 23, the angular orientation of the shaft 19 is such that with the key 35 and key way 34 aligned the operating member may be inserted into the sheath 32 with the opening 36 aligned for engagement with the end 31. Once they are engaged the operating member may be turned through substantially 180°. It will be seen that on such rotation the operating member becomes trapped within the sheath by virtue of the key 35 moving out of alignment with the key way 34. This rotation causes the eccentric section 18 to act on the eyes 17 to raise the bolt 10 so releasing the contact pressure from the links 7 and 8. The washer 26 resumes its wavy condition and thus maintains the links in light engagement with the conductors. When the full rotation has been completed the part 29 of the plate 20 has moved into alignment with the raised portion 28 on the housing section 4. Accordingly, the bridging contact can now be pivoted about its axis 9 without being restricted by the portion 28 and can be pulled by the operating member 30 into the open position shown in broken lines in FIG. 1 where the links 7 and 8 are out of engagement with and spaced from the input conductor 1. In order to remove the operating member it must be rotated back through substantially 180° so that the key again becomes aligned with the key way, and in so doing the orientation of the plate 20 again becomes such that the raised portion 28 prevents movement of the shaft within the housing. Thus, the bridging contact cannot be pushed back into a position where it engages the input conductor unless the operating member has again been properly engaged with the end of the shaft, and rotated to restore the links to the loosened condition.

It will be noted from FIG. 1 that when the bridging contact is in the open position a hook 37 on the housing section 15 engages with a stop 38 on the main housing. An inspection and maintenance facility can then be provided by depressing the hook 37 so allowing the bridging contact to be pivoted to a completely open position.

It will be seen that with the arrangement described there is provided an isolator that does not involve exposure of the operator to live metal during any normal operating sequence. Furthermore, contact pressure in normal service is applied by virtue of the cam action and does not rely in any way on the aid of springs. Additionally the relationship between the angular orientation of the plate 20 and raised portion 28 and the angular orientation of the key 35 and key way 34 ensure that the operating member cannot be moved into or out of engagement with the shaft unless the isolator is closed with contact pressure fully applied or the isolator is positively open.

It will be understood that the drawings show only one way in which these results can be achieved and that other arrangements for applying positive pressure to the bridging contact and for effecting the required interlocks may be used. The arrangement described is for a single pole but it will be appreciated that similar arrangements may be applied to each pole of a multi-pole isolator.

I claim:

1. An electrical isolator comprising an insulated housing, having an access opening therein, an input conductor and an output conductor mounted at spaced-apart locations within the housing, a bridging contact, means mounting the bridging contact within the housing for movement between an open position out of engagement with at least one of the conductors and a closed position in engagement with both conductors, an insulating shroud fully shielding that part of the bridging contact accessible through the access opening of the housing, and manually operable pressure-applying means associated with the bridging contact and such that the pressure-applying means may be operated when the bridging contact is in the closed position to control the bridging contact between a tightened condition wherein contact pressure is applied between the bridging contact and the conductors without the use of springs and a free condition wherein the contact pressure is reduced.

2. An electrical isolator according to claim 1 in which the pressure-applying means has a part engageable by an operating member, and the engageable part is insulated.

3. An electrical isolator according to claim 2 in which the engageable part of the pressure-applying means is accessible by a manually held tool inserted through an opening in the insulating shroud.

4. An electrical isolator according to claim 1 in which the pressure-applying means is such that the bridging contact is controlled between its free and tightened conditions simultaneously with respect to each of the two conductors.

5. An electrical isolator according to claim 1 in which the pressure-applying means is located within a space between the input and output conductors.

6. An electrical isolator according to claim 1 in which the pressure-applying means comprises a cam arrangement.

7. An elecrical isolator according to claim 6 in which the bridging contact comprises opposed links, one lying to each of two opposite sides of the conductor, and the cam arrangement is such as to move the links from the free condition towards each other into the tightened condition.

8. An electrical isolator according to claim 1 and including interlock means preventing movement of the bridging contact from the closed position to the open position unless the bridging contact is in the free condition.

9. An electrical isolator according to claim 1 and including interlock means preventing movement of the bridging contact from the open position to the closed position unless the bridging contact is in the free condition.

10. An electrical isolator according to claim 1 and including interlock means preventing control of the bridging contact between the free and tightened conditions unless the bridging contact is in either the closed or the open position.

11. An electrical isolator according to claim 2, including interlock means preventing engagement and disengagement of the operating member with the pressure-applying means unless the bridging contact is in either the closed or open position.

12. An electrical isolator according to claim 6 in which the cam arrangement comprises a rotary cam and a drive shaft therefor, the shaft carrying an interlock member co-operable with an interlock member on the isolator housing to prevent movement of the bridging contact between its open and closed positions unless the angular orientation of the shaft corresponds to the free condition of the bridging contact.

13. An electrical isolator according to claim 12 in which the shaft and the insulated housing have further interlock means to ensure that a manually held tool for operating the pressure-applying means can only be engaged with the shaft when the angular orientation of the shaft corresponds to the free condition of the bridging contact.

* * * * *